US006705977B1

(12) United States Patent
Ziak

(10) Patent No.: US 6,705,977 B1
(45) Date of Patent: Mar. 16, 2004

(54) BALANCE BOARD

(76) Inventor: Frantisek Ziak, 1030 Cecile Dr. #1, Pon Moody, British Columbia (CA), V4H 1M4

( * ) Notice: Subject to any disclaimer, the term of this patent is extended or adjusted under 35 U.S.C. 154(b) by 0 days.

(21) Appl. No.: 09/454,241

(22) Filed: Dec. 2, 1999

(30) Foreign Application Priority Data

Jun. 4, 1997 (CA) ..... 2206028
Jun. 2, 1998 (WO) ..... PCT/CA/00539

(51) Int. Cl.[7] ..... A63B 22/16
(52) U.S. Cl. ..... 482/146; 482/79; 472/135
(58) Field of Search ..... 482/34, 79–80, 482/146–148; 472/135, 127, 108, 114; 36/7, 8, 114

(56) References Cited

U.S. PATENT DOCUMENTS

| | | | | | |
|---|---|---|---|---|---|
| 3,024,021 | A | * | 3/1962 | Cpolin et al. | 272/57 |
| 3,451,672 | A | | 6/1969 | Kazdan | 272/30 |
| 3,488,049 | A | | 1/1970 | Sasser | 272/1 |
| 3,531,110 | A | * | 9/1970 | Marchu | |
| 3,586,321 | A | | 6/1971 | Gehrke | 272/33 |
| 3,862,768 | A | | 1/1975 | England | 280/205 |
| 3,961,787 | A | | 6/1976 | Studebaker et al. | 272/93 |
| 4,376,532 | A | * | 3/1983 | Hunstad | 272/97 |
| 4,491,318 | A | | 1/1985 | Francke | 272/146 |
| 4,505,477 | A | | 3/1985 | Wilkinson | 272/146 |
| 4,601,469 | A | | 7/1986 | Sasser | 272/146 |
| 4,759,542 | A | * | 7/1988 | Hudec | 272/111 |
| 4,787,630 | A | * | 11/1988 | Watson et al. | 482/146 |
| 4,826,159 | A | * | 5/1989 | Hersey | 272/146 |
| 4,850,588 | A | | 7/1989 | Desjardins et al. | 272/111 |
| 5,048,823 | A | | 9/1991 | Bean | 272/111 |
| 5,127,672 | A | * | 7/1992 | Horibata | 280/842 |
| 5,190,506 | A | | 3/1993 | Zubik et al. | 482/68 |
| 5,292,296 | A | | 3/1994 | Davignon | 482/146 |
| 5,399,140 | A | | 3/1995 | Klippel | 482/146 |
| 5,454,772 | A | * | 10/1995 | Rodden | 482/54 |
| 5,529,551 | A | * | 6/1996 | Chin | 482/49 |
| 5,820,096 | A | * | 10/1998 | Lynch et al. | 248/346.01 |
| 5,897,474 | A | * | 4/1999 | Romero | 482/146 |
| 6,413,197 | B2 | * | 7/2002 | McKechnie et al. | 482/146 |

FOREIGN PATENT DOCUMENTS

| | | | | |
|---|---|---|---|---|
| FR | 2410486 | * | 12/1977 | |
| GB | 2-270 634 A | * | 3/1994 | 482/79 |

OTHER PUBLICATIONS

International Search Report, PCT/CA98/00539, Sep. 22, 1998.
PCT Written Opinion, PCT/CA98/00539, Mar. 9, 1999.
PCT International Preliminary Examination Report, PCT/CA98/00539, Sep. 10, 1999.

* cited by examiner

*Primary Examiner*—Nicholas D. Lucchesi
*Assistant Examiner*—Victor Hwang
(74) *Attorney, Agent, or Firm*—Kolisch Hartwell, P.C.

(57) ABSTRACT

A balance board comprising a platform (4) to support a user, a ground contacting rocker member (8) having a rounded surface (16) to permit pivoting of the platform about a first axis (10), and an interconnecting member (14) extending between the rocker member and the platform to permit pivoting of the platform about a second axis (11) substantially perpendicular to the first axis and about a third axis (12) substantially perpendicular to the first and second axes. The interconnecting member and the rocker member cooperate to define a central pivot region, for pivoting of the platform about the three axes. Preferably, the balance board includes stop members (30) to adjust the pivoting movement of the platform about at least one of the axes to make balancing of the platform adjustable depending on the skill level of the user. The balance board is used as an exercise device to improve and develop the balancing ability of a user.

14 Claims, 3 Drawing Sheets

BALANCE BOARD

FIELD OF THE INVENTION

This invention relates generally to the field of sports and exercise equipment, and, in particular to a balance board for improving and developing the balancing ability of an individual.

BACKGROUND OF THE INVENTION

Developing a good sense of balance is generally a matter of practice. Many popular sports activities require a well developed sense of balance in order to become proficient. For example, sports such as cycling, skiing, snowboarding, skateboarding and the like all involve the use of equipment that requires the user to be able to accurately control their position on the equipment. Continuous shifting and adjustment of the user's weight and centre of gravity with respect to the equipment at appropriate times is vital to proper use of the equipment and full enjoyment of the sport.

In the normal course of growing up, a person must develop quite an advance sense of balance in order to graduate from a baby's crawling movements to the common walking and running movements of a child or adult. However, once the walking and running movements are mastered, a reliable sense of balance for manoeuvring in the everyday world is taken for granted by most people. To a large extent, everyday play of a child develops and refines the sense of balance. Common toys and sporting equipment such as bicycles, skateboards and snowboards also allow a person to practice and further develop their sense of balance.

In order to concentrate on developing balancing skills, equipment known as balance boards has been developed. Prior art balancing boards and other relevant exercise equipment known to the applicant are described in the following patents:

U.S. Pat. No. 842,462 to Grafin
U.S. Pat. No. 3,451,672 to Kazdan
U.S. Pat. No. 3,488,049 to Sasser
U.S. Pat. No. 3,491,189 to Mutius
U.S. Pat. No. 3,586,321 to Gehrke
U.S. Pat. No. 3,862,768 to England
U.S. Pat. No. 3,961,787 to Studebaker
U.S. Pat. No. 4,491,318 to Francke
U.S. Pat. No. 4,505,477 to Wilkinson
U.S. Pat. No. 4,601,469 to Sasser
U.S. Pat. No. 4,759,542 to Hudec
U.S. Pat. No. 4,850,588 to Desjardins
U.S. Pat. No. 5,048,823 to Bean
U.S. Pat. No. 5,190,506 to Zubik et al.
U.S. Pat. No. 5,292,296 to Davignon
U.S. Pat. No. 5,399,140 to Klippels Many prior art balancing boards involve a platform that is pivotable about a singe axis. While this arrangement is initially challenging for a beginner, with practice, it becomes relatively easy to master. Alternatively, other balancing board designs rely on a spherical or hemi-spherical pivot point that permits movement in all directions. Such a design requires an well developed sense of balance to use and it is therefore best suited to an advanced user. Unfortunately, for a beginner, a spherical or hemi-spherical pivot is frustrating to use as it is very difficult to balance on consistently.

SUMMARY OF THE INVENTION

To overcome the shortcomings of prior art balancing boards, applicant has developed a balance board that relies on a unique pivot point arrangement that permits end to end, side to side and torsional movement about first, second and third axes alone and in combination.

Accordingly, the present invention provides a balance board comprising:

a platform to support a user;

a ground contacting member having a rounded lower surface in contact with the ground to permit pivoting of the platform about a first axis; and a resiliently deformable interconnecting member mounted between the ground contacting member and the platform to permit pivoting of the platform about a second axis substantially perpendicular to the first axis and about a third axis substantially perpendicular to the first and second axes, the interconnecting member being shaped and dimensioned to substantially resist bending in all other directions.

As well, the balance board of the present invention includes a stop system that permits the pivotability of the board about at least one of the pivoting axes to be adjusted so that the balance board can be used by beginner, intermediate and advanced users. In a preferred arrangement, the system uses a stop member extending from the platform to engage with a fixed surface when the platform is pivoted to a pre-determined extent to limit further pivoting. The stop member can be resiliently deformable and includes means to adjust its deformability so that the extent of pivoting of the platform can be varied according to the skill level of the user.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Referring to FIGS. 1–4, there is shown a balance board 2 according to a preferred embodiment of the present invention. The balance board comprises a elongate platform 4 of rigid material that is supported by a centrally located pivoting arrangement 6. Platform 4 is preferably provided with non-slip pads 7 on which a user places their feet. The user can adopt various foot positions while standing on platform 4, and in all cases, must continually adjust their balance in an attempt to keep platform 4 substantially horizontal as the platform pivots about pivoting arrangement 6.

Figure 1:
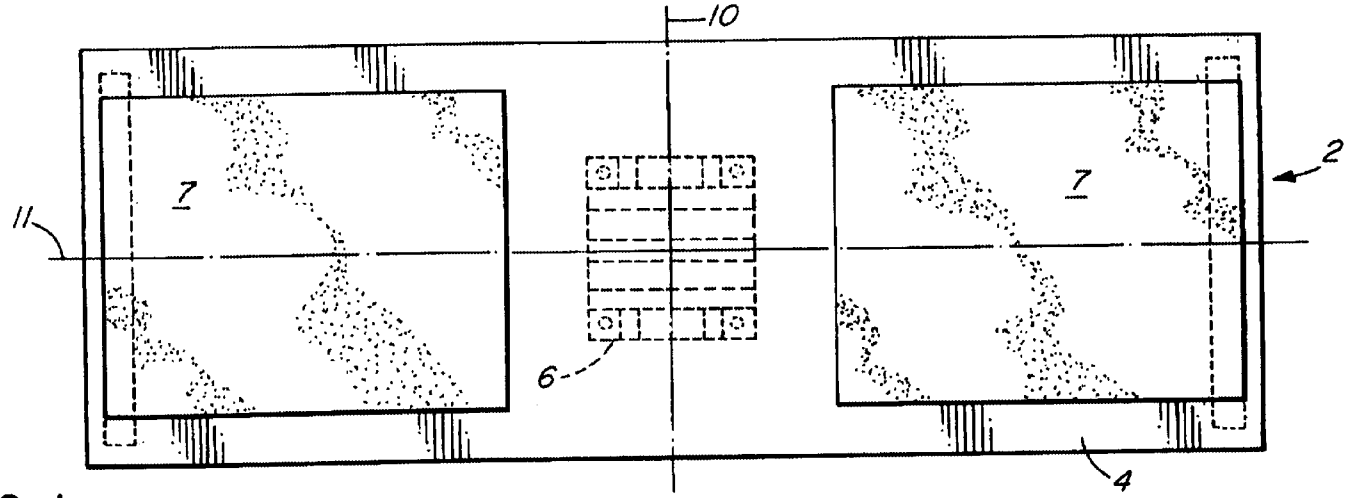
FIG. 1 is a top plan view of a balance board according to a preferred embodiment of the present invention.
Figure 2:
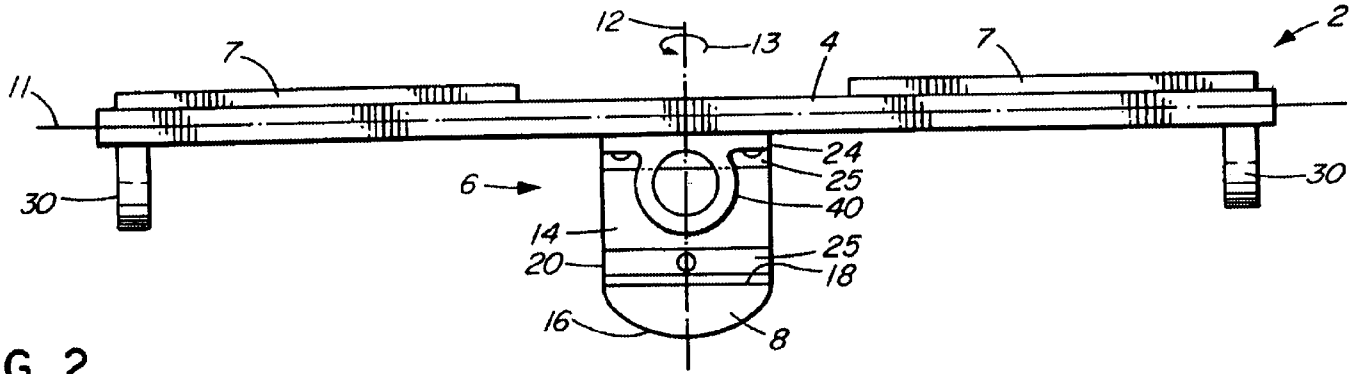
FIG. 2 is a side elevation view of the balance board of FIG. 1.
Figure 4:
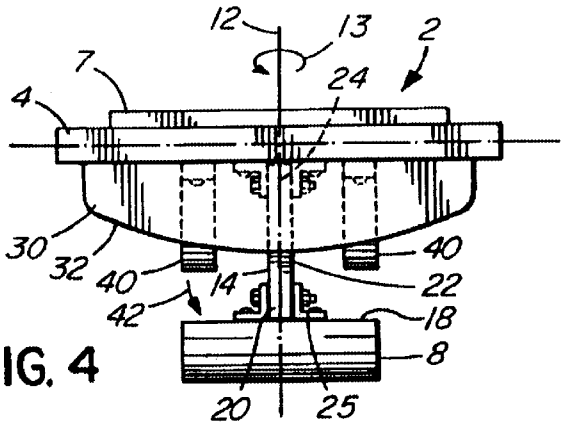
FIG. 4 is a end elevation view of the balance board of FIG. 1.

As best shown in FIGS. 2 and 4, pivoting arrangement 6 comprises a ground contacting member 8 having a surface to permit pivoting of the platform about a first axis 10 extending transversely across platform 4. There is also an interconnecting member 14 mounted between ground contacting member 8 and the underside of platform 4 to permit pivoting of the platform about a second axis 11 extending longitudinally of platform 4 and substantially perpendicularly to first axis 10. At the same time, interconnecting member 14 permits pivoting, as shown by arrow 13 in FIGS. 2 and 4, about a third axis 12 that is substantially perpendicular to the first and second axes.

Preferably, ground contacting member 8 is a block of rigid material, such as wood, formed with a rounded lower surface 16 that contacts with the ground and is oriented to permit rocking of platform 4 about transverse axis 10.

Interconnecting member 14 preferably comprises a piece of material shaped and dimensioned to be resiliently deformable to allow pivoting about second and third axes, 11 and 12, respectively, while remaining rigid in all other directions. In a preferred embodiment, interconnecting member 14 comprises an elongate block formed from urethane having a hardness of in the range of 60–90 on the Shore Durometer A Scale. The urethane block is positioned vertically such that the plane of its thinnest edge 22 is perpendicular to the second, longitudinal axis 11. Thus, the weight of a user on platform 4 tends to bend interconnecting member 14 to one side or the other across its thinnest edge 22 resulting effectively in pivoting of the board about axis 11 which must be counteracted by the user appropriately adjusting their balance. Interconnecting member 14 in the form of the urethane block also tends to pivot or twist to a limited extent about essentially vertical axis 12. Otherwise, the urethane block is dimensioned and oriented such that it is effectively rigid about first axis 10.

Figure 7:
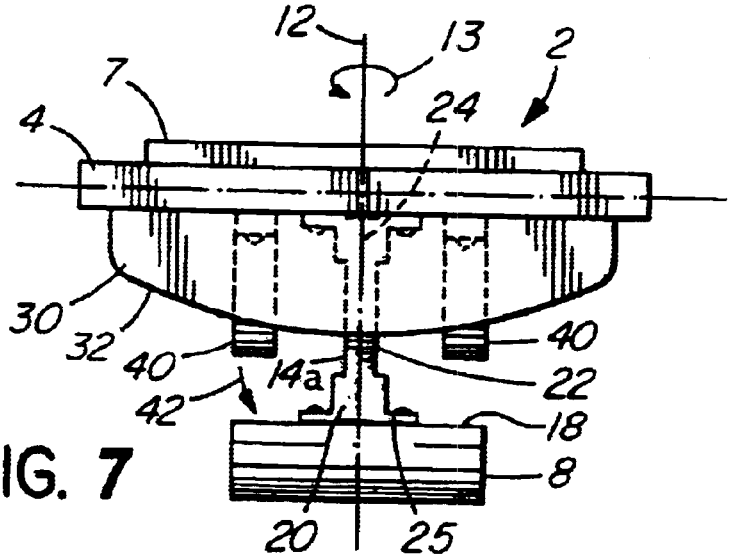
FIG. 7 is an end elevation view of an alternative embodiment with integral mounting flanges formed in the elongate block.

In the illustrated embodiment, the upper end 24 and the lower end 20 of the interconnecting member 14 are fastened to the lower surface of platform 4 and the upper surface 18 of ground contacting member 8, respectively, by pairs of spaced L-shaped brackets 25. Fasteners extend through one arm of each bracket to be anchored in to the platform or the ground contacting member and through the other arm of each bracket and through the interconnecting member to secure the bracket and the interconnecting member together. Preferably, the upper surface 18 of ground contacting member 8 is flat to facilitate mounting of the lower end 20 of interconnecting member 14 thereto. It is also possible to use the as the interconnecting member and elongate block that is formed with integral mounting flanges. Such a block 14*a*, as illustrated in FIG. 7, would have a generally I-shaped cross-section with the upper and lower arms or flanges of the "I" being adapted to receive fasteners for mounting the block to the platform and the ground contacting member.

It will be readily apparent to those skilled in the art that other materials besides urethane can be used to form interconnecting member 14. Examples of alternative resiliently deformable materials include rubber, metal and plastic.

Figure 3:
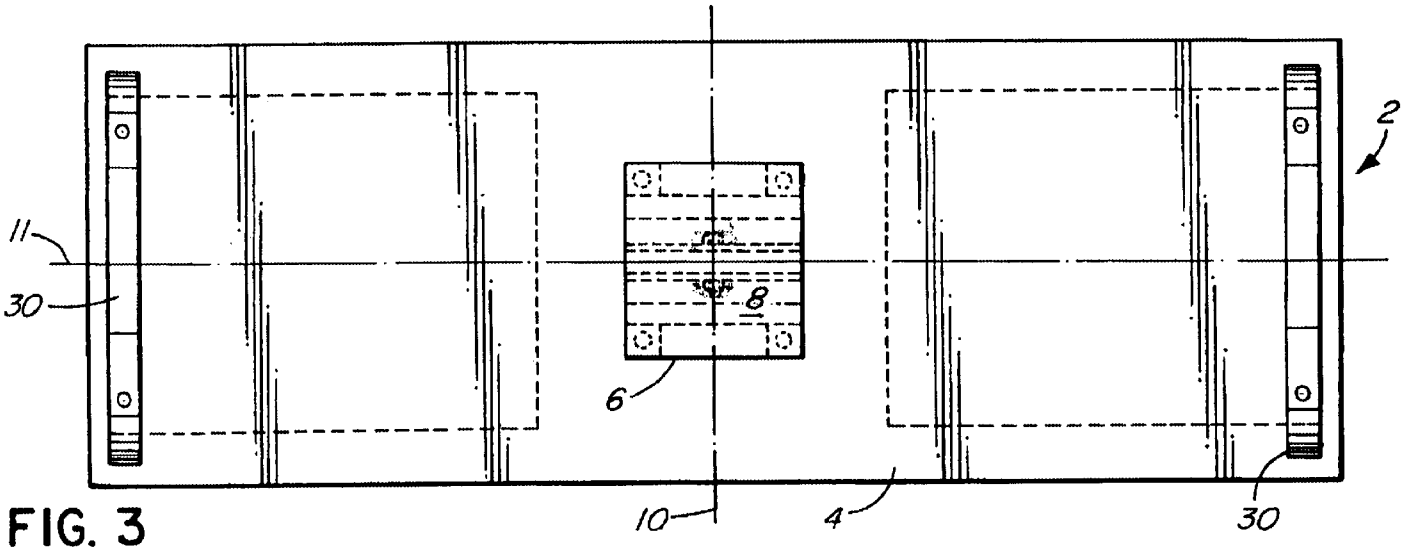
FIG. 3 is a bottom plan view of the balance board of FIG. 1.
Figure 6B:
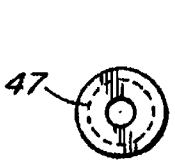
FIG. 6*b* is an end view of the insert of FIG. 6*a*.
Figure 6A:
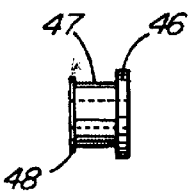
FIG. 6*a* is a side view of an insert for use with the stop member.

The balance board of the present invention includes stop members to limit pivoting of the platform about at least one of the pivoting axes. An example of such stop members is shown in FIGS. 2, 3 and 4. The members comprise projections 30 that extend downwardly from the lower surface of platform 4 to engage with the ground when the platform is pivoted to a pre-determined extent to limit further pivoting. Projections 30 are positioned at the ends of the platform to limit pivoting about first axis 10. As best shown in FIG. 4, projections 30 have rounded or arcuate lower surface 32 to accommodate pivoting of platform 4 about second axis 11 even when a projection 30 is in contact with the ground. In general, projections 30 would be fitted only when the balance board is being used by a beginner.

Figure 5:
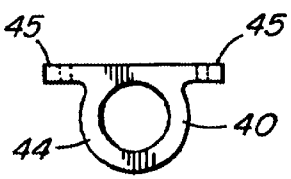
FIG. 5 is a detail view of a stop member for use with the balance board of the present invention.

An additional arrangement of stop members 40 can be used to limit movement about one of the pivot axes of the platform by engaging with the ground contacting member 8 when the platform is pivoted to a pre-determined extent. Examples of a such stop members are best illustrated in FIGS. 2 and 5. Stop members 40 are positioned adjacent pivoting arrangement 6 on opposite sides of the platform to limit pivoting about second axis 11. Stop members 40 and interconnecting member 14 are dimensioned so that there is a space between the stop members and the ground contacting member when the balance board is in its default, generally horizontal, position. As best shown in FIG. 4 by arrow 42, when interconnecting member 14 deforms to one side to produce pivoting about axis 11, stop member 40 on that side will move downwardly to contact upper surface 18 of ground contacting member 8 to prevent further pivoting movement.

Stop members 40 can be formed from a rigid material to immediately prevent further movement when they contact upper surface 18. Alternatively, stop members 40 can be formed from a resiliently deformable material that flexes and gives so that there is not an abrupt stop when stop members 40 contact upper surface 18.

As illustrated, stop members 40 are preferably formed in the shape of a ring 44 with attachment flanges 45 for mounting the ring to the underside of platform 4. Ring 44 and flanges 45 are formed from a resiliently deformable material such as urethane. The advantage of the ring design is that deformation of the ring provides additional resiliency and accommodates additional movement about second axis 11 to increase the challenge of maintaining one's balance while still limiting pivoting movement.

To adjust the deformability of ring 44, an insert 47 is installable within the centre of ring 44 to increase the stiffness of the ring member and thereby decrease pivoting about the second axis. Insert 47 is essentially a plug that is press fitted into place within ring 44. An annular flange 46 is formed at one end of insert 47 to prevent the insert from being pushed through ring 44. Preferably, a small lip 48 is formed at the other end of the insert to prevent the insert from being squeezed out of ring 44 when the ring member is compressed between platform 4 and ground contacting member 8. Alternatively, the exterior of insert 47 and the interior of ring 44 can be correspondingly threaded to ensure that insert 47 remains in place when installed.

When using the balance board of the present invention, a beginner will probably prefer to use inserts 47 installed in rings 44 to minimize pivoting about second axis 11. As a user becomes more skilled, they can remove inserts 47 to create additional pivoting movement about second axis 11 to increase the challenge of balancing. At an advanced level, stop members 40 can be removed altogether from the lower surface of platform 4 so that movement about the second axis 11 is unhindered and the considerable skill of the user is required to keep the balance board substantially level.

As well as being a useful tool to develop balancing ability, the balance board of the present invention is an effective exercise apparatus. For example, a user can perform a routine of squats and stretches while balanced on the board. Maintaining one's balance while performing such exercise requires considerable energy and is particularly useful for stretching and conditioning the tendons and ligaments of the leg, ankle and foot. In fact, the balance board of the present invention has been found to be useful by physiotherapists for treatment and rehabilitation exercises, particularly of the ankle and foot. The board is used in its beginner configuration and is equipped with projections 30 at the ends of platform 4 to substantially limit the pivoting motion of the board.

Although the present invention has been described in some detail by way of example for purposes of clarity and understanding, it will be apparent that certain changes and modifications may be practised within the scope of the appended claims.

I claim:

1. A balance board comprising:

a platform to support a user;

a ground contacting member having a semi-cylindrical lower surface to permit a first rocking movement of the platform only about a first axis;

a resiliently deformable interconnecting member comprising an elongate block formed with integral mounting flanges to receive fasteners for mounting the block between the ground contacting member and the platform, the interconnecting member being deformable to permit a second rocking movement of the platform that is independent of the first rocking movement about a second axis that is generally perpendicular to the first axis, and the member being deformable to permit rotation of the platform about a third axis that is perpendicular to the first and second axes.

2. A balance board as claimed in claim 1 in which the interconnecting member is formed from urethane having a hardness in the range of about 60–90 on the Shore Durometer A Scale.

3. A balance board as claimed in claim 1 including stop members to vary and limit pivoting of the platform about at least one of the pivoting axes.

4. A balance board as claimed in claim 3 in which the stop member comprise members extending from the platform to engage with the ground when the platform is pivoted to a pre-determined extent to limit further pivoting.

5. A balance board as claimed in claim 4 in which the stop members are positioned at the ends of the platform to limit pivoting about the first axis, the members having rounded lower surfaces to permit pivoting about the second axis.

6. A balance board as claimed in claim 3 in which the stop members comprise members extending from the platform to engage with the ground contacting member when the platform is pivoted to a pre-determined extent to limit further pivoting.

7. A balance board as claimed in claim 6 in which the stop members are positioned adjacent the interconnecting member on opposite sides of the platform to limit pivoting about the second axis.

8. A balance board as claimed in claim 6 in which the stop members are resiliently deformable.

9. A balance board as claimed in claim 6 in which the stop members comprise ring members that are resiliently deformable.

10. A balance board as claimed in claim 9 including a removable insert installable within each ring member to modify the stiffness of the ring member and thereby the extent to which pivoting about the second axis is limited by the ring member.

11. A balance board as claimed in claim 3 in which the stop members are adjustable to vary the extent to which the stop members limit pivoting about at least one of the pivoting axes.

12. A balance board as claimed in claim 11 in which stop members comprise ring members that are resiliently deformable and extend downwardly from the platform to engage with the ground contacting member when the platform is pivoted to a pre-determined extent to limit further pivoting, the ring members including a removable insert installable within each ring member to increase the stiffness of the ring member and thereby decrease the deformability of the ring.

13. A balance board comprising:

a platform to support a user;

a ground contacting member having a semi-cylindrical lower surface to permit a first rocking movement of the platform only about a first axis;

a resiliently deformable interconnecting member comprising an elongate block extending between the ground contacting member and the platform, the interconnecting member being deformable to permit a second rocking movement of the platform that is independent of the first rocking movement about a second axis that is generally perpendicular to the first axis and the member being deformable to permit rotation of the platform about a third axis that is generally perpendicular to the first and second axes; and stop members to vary and limit pivoting of the platform about at least one of the axes comprising resiliently deformable ring members extending from the platform to engage with the ground contacting member.

14. A balance board as claimed in claim 13 including a removable insert installable within each ring member to modify the stiffness and deformability of the ring member and thereby the extent to which pivoting about at least one of the axes is limited by the ring member.

* * * * *